US009545538B2

(12) United States Patent
Hinkle

(10) Patent No.: US 9,545,538 B2
(45) Date of Patent: Jan. 17, 2017

(54) FOLDABLE RECUMBENT STEPPER EXERCISE DEVICE

(71) Applicant: Nicholas Hinkle, Wooster, OH (US)

(72) Inventor: Nicholas Hinkle, Wooster, OH (US)

( * ) Notice: Subject to any disclaimer, the term of this patent is extended or adjusted under 35 U.S.C. 154(b) by 34 days.

(21) Appl. No.: 14/478,725

(22) Filed: Sep. 5, 2014

(65) Prior Publication Data

US 2015/0065307 A1 Mar. 5, 2015

Related U.S. Application Data

(60) Provisional application No. 61/873,888, filed on Sep. 5, 2013.

(51) Int. Cl.

| | |
|---|---|
| ***A63B 22/04*** | (2006.01) |
| ***A63B 22/00*** | (2006.01) |
| *A63B 21/008* | (2006.01) |
| *A63B 21/02* | (2006.01) |
| *A63B 22/20* | (2006.01) |

(52) U.S. Cl.

CPC ..... *A63B 22/0056* (2013.01); *A63B 22/001* (2013.01); *A63B 21/0083* (2013.01); *A63B 21/0087* (2013.01); *A63B 21/023* (2013.01); *A63B 21/026* (2013.01); *A63B 22/203* (2013.01); *A63B 2022/0043* (2013.01); *A63B 2208/0238* (2013.01); *A63B 2210/50* (2013.01)

(58) Field of Classification Search

CPC . A63B 22/0056; A63B 22/001; A63B 22/203; A63B 2022/0043; A63B 21/0083; A63B 21/023;A63B 21/0087; A63B 21/026; A63B 2208/0238; A63B 2210/50

See application file for complete search history.

(56) References Cited

U.S. PATENT DOCUMENTS

| | | | | |
|---|---|---|---|---|
| 4,949,954 | A * | 8/1990 | Hix | A63B 21/018 482/60 |
| 6,932,745 | B1 | 8/2005 | Ellis | |
| 7,497,812 | B2 * | 3/2009 | Neff | A63B 21/008 482/51 |
| D610,635 | S | 2/2010 | Hildebrandt et al. | |
| 7,713,176 | B1 | 5/2010 | Farney | |
| 7,775,942 | B2 | 8/2010 | Hildebrandt et al. | |
| 7,846,074 | B2 | 12/2010 | Wu | |
| 7,993,247 | B1 * | 8/2011 | Eschenbach | A63B 22/001 482/51 |
| 8,062,191 | B2 | 11/2011 | Coates | |
| D650,871 | S | 12/2011 | Sarns et al. | |

(Continued)

*Primary Examiner* — Loan H Thanh
*Assistant Examiner* — Megan Anderson

(57) ABSTRACT

A portable recumbent stepper device may comprise a frame which may have a main body in the form of a beam extending fore-to-aft. The frame may also include a front leg and a rear base both for providing vertical and lateral support. The device may include an upward frame element fixedly joined to the fore end of the main body. A pair of foot pedals may be hingedly joined to the upward frame element. A pair of upwardly extending handles may be hingedly joined to the upward frame element and to the foot pedals so that they move in unison with the foot pedals, and the handles may be swept rearward to accommodate a seated user. A pair of resistance elements may be joined to the frame at one end and to one of the pair of foot pedals at another end.

7 Claims, 8 Drawing Sheets

(56) References Cited

U.S. PATENT DOCUMENTS

| | | | | |
|---|---|---|---|---|
| 2006/0073942 | A1* | 4/2006 | Yang | A63B 22/001 482/53 |
| 2008/0146421 | A1* | 6/2008 | Hsieh | A63B 21/02 482/129 |
| 2011/0218078 | A1 | 9/2011 | Coates | |
| 2012/0077653 | A1* | 3/2012 | Dedov | A47C 9/002 482/139 |
| 2013/0090217 | A1 | 4/2013 | Sarns et al. | |

* cited by examiner

FOLDABLE RECUMBENT STEPPER EXERCISE DEVICE

This application claims the benefit of U.S. Provisional Patent Application No. 61/873,888 filed Sep. 5, 2013 and which is incorporated herein by reference in its entirety.

I. BACKGROUND OF THE INVENTION

A. Field of Invention

Embodiments of the invention may generally relate to portable exercise devices wherein the user remains seated or reclined.

B. Description of the Related Art

Stepper exercise devices are known in the art. Many require a user to stand on the device and provide the user with resistance to his stepping motion either with or without arm rowing motions. Some devices enable a user to exercise with the device from a seated position. Typically, such devices include an integrated seat and the resistance mechanism may be housed partially under the seat. What is absent from the art is an easily portable device. Such devices would be especially useful to home healthcare workers who may conduct physical or occupational therapy sessions in patients' homes. Such persons may find it advantageous to have an easily portable device which could be carried from site to site.

Some embodiments of the present invention may provide one or more benefits or advantages over the prior art.

II. SUMMARY OF THE INVENTION

Some embodiments may relate to a portable recumbent stepper device, comprising: a frame having a main body defined by at least one fore-to-aft beam, a front leg joined to a fore end of the main body and adapted to provide vertical support and lateral stabilization to the main body, and a rear support comprising an aft end of the main body and adapted to provide vertical support and lateral stabilization to the main body; an upward frame element fixedly joined to the fore end of the main body and adapted to extend upwardly when the device is in a deployed configuration; a pair of foot pedals hingedly joined to the upward frame element; a pair of upwardly extending handles hingedly joined to the upward frame element at a substantially right angle relative to the foot pedals and through common joints with the foot pedals, wherein each of the pair of upwardly extending handles hingedly moves in unison with a corresponding foot pedal, and wherein the motion of either the foot pedal or the corresponding upwardly extending handle results in hinged motion of the other; a pair of resistance elements each joined to the frame at one end and to one of the pair of foot pedals at another end; and the portable recumbent stepper device lacking a seat for a human user, and instead being adapted to cooperate with an arbitrary seat provided by the user, wherein the seat is disposed rearward of the frame.

According to some embodiments, the rear support further comprises a rearwardly extendable base hingedly joined to the aft end of the main body.

According to some embodiments, the rearwardly extendable base further comprises a T-shaped beam, wherein the T-shaped beam is adapted to lay flat on a floor when the device is in a deployed configuration, and adapted to be folded inward in a stowed configuration.

According to some embodiments, the front leg is hingedly joined to the main body and adapted to be configurable in a deployed or stowed relation to the main beam.

According to some embodiments, each of the upwardly extending handles includes a length reduction means for compacting the upwardly extending handles into a stowed configuration.

According to some embodiments, each of the upwardly extending handles is configurable in a rearwardly swept configuration adapted to accommodate a seated user.

According to some embodiments, each of the pair of resistance elements is hingedly joined at one end to the frame and at another end to one of the pair of foot pedals.

According to some embodiments, each of the pair of resistance elements is independently selected from a hydraulic cylinder, a coil spring, a leaf spring, and a gas spring.

Some embodiments may include a handle joined to the frame and extending from the frame beyond a chassis of the device.

Embodiments may relate to a portable recumbent stepper device, comprising: a frame having a main body defined by at least one fore-to-aft beam, a front leg joined to a fore end of the main body and adapted to provide vertical support and lateral stabilization to the main body, and a rear support comprising an aft end of the main body and adapted to provide vertical support and lateral stabilization to the main body; an upward frame element fixedly joined to the fore end of the main body and adapted to extend upwardly when the device is in a deployed configuration; a pair of foot pedals hingedly joined to the upward frame element; a pair of upwardly extending handles hingedly joined to the upward frame element at a substantially right angle relative to the foot pedals and through common joints with the foot pedals, wherein each of the pair of upwardly extending handles hingedly moves in unison with a corresponding foot pedal, wherein the motion of either the foot pedal or the corresponding upwardly extending handle results in hinged motion of the other, and wherein each of the upwardly extending handles includes a length reduction means for compacting the upwardly extending handles into a stowed configuration; a pair of resistance elements each hingedly joined to the frame at one end and hingedly joined to one of the pair of foot pedals at another end, wherein each of the pair of resistance elements is independently selected from a hydraulic cylinder, a coil spring, a leaf spring, and a gas spring; a handle joined to the frame and extending from the frame beyond a chassis of the device; and the portable recumbent stepper device lacking a seat for a human user, and instead being adapted to cooperate with an arbitrary seat provided by the user, wherein the seat is disposed rearward of the frame.

According to some embodiments, the rear support further comprises a rearwardly extendable base hingedly joined to the aft end of the main body.

According to some embodiments, the rearwardly extendable base further comprises a T-shaped beam, wherein the T-shaped beam is adapted to lay flat on a floor when the device is in a deployed configuration, and adapted to be folded inward in a stowed configuration.

According to some embodiments, the front leg is hingedly joined to the main body and adapted to be configurable in a deployed or stowed relation to the main beam.

According to some embodiments, each of the upwardly extending handles is configurable in a rearwardly swept configuration adapted to accommodate a seated user.

Embodiments may relate to a portable recumbent stepper device, comprising: a frame having a main body defined by at least one fore-to-aft beam, a front leg hingedly joined to a fore end of the main body and adapted to provide vertical support and lateral stabilization to the main body when in a deployed configuration while also being configurable to a stowed configuration, and a rear support comprising an aft end of the main body and adapted to provide vertical support and lateral stabilization to the main body; an upward frame element fixedly joined to the fore end of the main body and adapted to extend upwardly when the device is in a deployed configuration; a pair of foot pedals hingedly joined to the upward frame element; a pair of upwardly extending handles hingedly joined to the upward frame element at a substantially right angle relative to the foot pedals and through common joints with the foot pedals, wherein each of the pair of upwardly extending handles hingedly moves in unison with a corresponding foot pedal, wherein the motion of either the foot pedal or the corresponding upwardly extending handle results in hinged motion of the other, wherein each of the upwardly extending handles includes a length reduction means for compacting the upwardly extending handles into a stowed configuration, wherein each of the upwardly extending handles is configurable in a rearwardly swept configuration adapted to accommodate a seated user; a pair of resistance elements each hingedly joined to the frame at one end and hingedly joined to one of the pair of foot pedals at another end, wherein each of the pair of resistance elements is independently selected from a hydraulic cylinder, a coil spring, a leaf spring, and a gas spring; a chassis substantially enclosing the frame while allowing the foot pedals and the upwardly extending handles to protrude therefrom; a handle joined to the frame and extending from the frame beyond the chassis of the device; and the portable recumbent stepper device lacking a seat for a human user, and instead being adapted to cooperate with an arbitrary seat provided by the user, wherein the seat is disposed rearward of the frame.

According to some embodiments, the rear support further comprises a rearwardly extendable base hingedly joined to the aft end of the main body.

According to some embodiments, the rearwardly extendable base further comprises a T-shaped beam, wherein the T-shaped beam is adapted to lay flat on a floor when the device is in a deployed configuration, and adapted to be folded inward in a stowed configuration.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Recumbent stepper devices according to embodiments of the invention may include a small-profile structure enabling a user to exercise with the device while seated in an arbitrary user-provided seat or chair. Furthermore, the device may include handles adapted to enable a rowing motion performed by a user while simultaneously engaging in a stepping motion. Advantageously, the handles may be configured or configurable into a rearwardly swept orientation to accommodate a seated user. More specifically, during use the device may be placed in front of a user-provided seat, thus sweeping the handles rearward would better position the handles within reach of a seated user thereby allowing the user to grip the device in a more natural position. Embodiments may also include foldable, collapsible, and/or stowable components so that the device may be packed and easily carried or otherwise transported more or less by hand. Such embodiments may advantageously include a handle built into the frame and/or chassis of the device.

Figure 1:
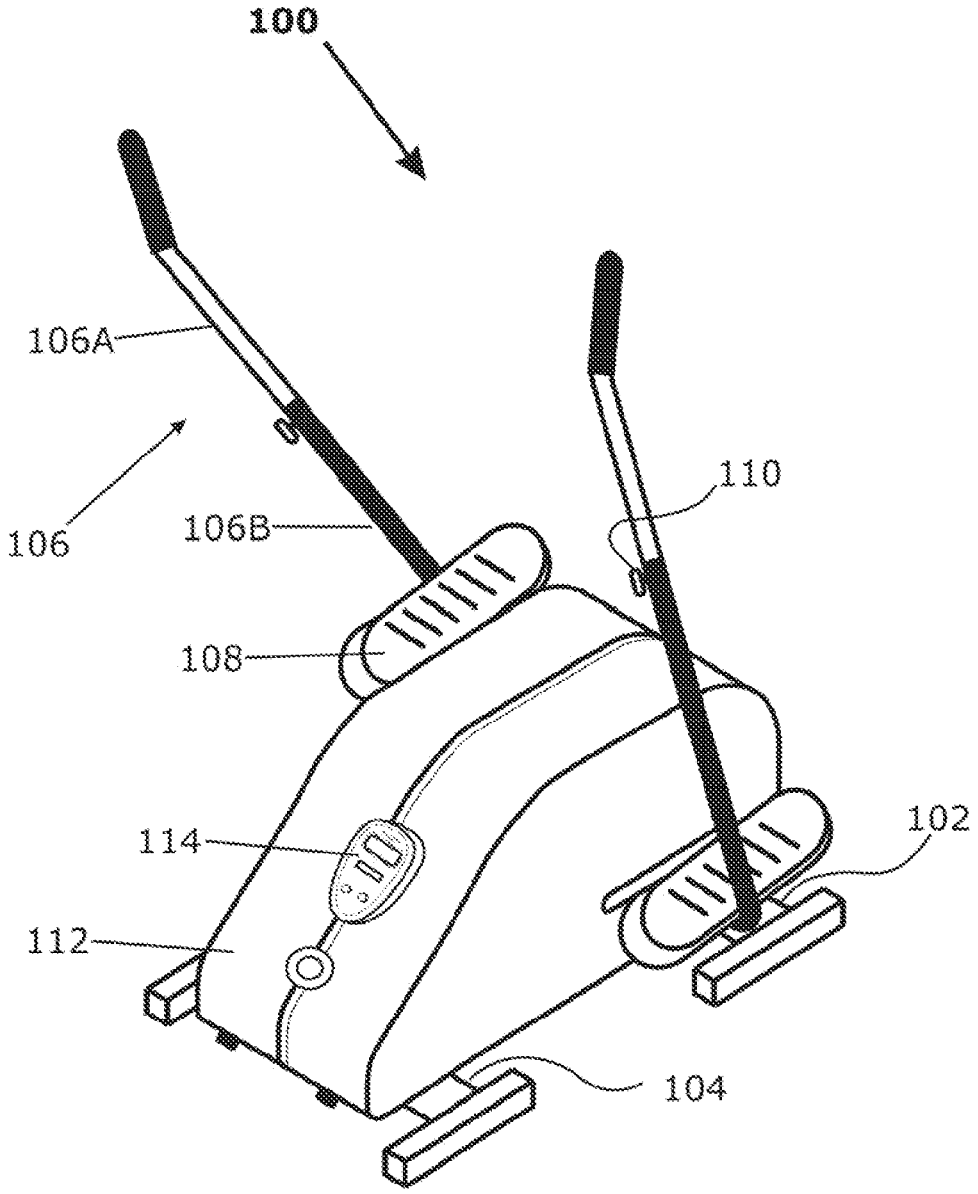
FIG. 1 is a is an elevation view of an embodiment.

Referring now to the drawings wherein the showings are for purposes of illustrating embodiments of the invention only and not for purposes of limiting the same, FIG. 1 is an elevation view of an embodiment 100 having a chassis 112. Thus, the frame components of this embodiment 100 are largely hidden from view. The device includes a pair of upwardly extending handles 106, which in this embodiment each comprise a pair of telescoping length-adjustment components for changing the overall length of the handles 106. Particularly, the handles 106 include an upper shaft 106A and a lower shaft 106B which receives the upper shaft 106A in a telescoping relation. The length of the handles 106 can be adjusted by loosening knob 110, changing the relative position of the upper and lower shafts 106A, 106B and retightening the knob 110. Other length-changing means are known in the art and within the scope of the invention. For instance, the handles may be foldable about a hinged joint located in a middle region of the handles 106. Advantageously, such a hinged joint may include components for locking the handles 106 in a selected configuration, i.e. folded or unfolded.

In the embodiment 100 of FIG. 1 the handles 106 connect to the pedals 108, which are in turn hingedly connected to the frame of the device. Thus it may be said that the handles 106 attach to the frame of the device through a common joint with the pedals 108; both the pedals and the handles owe their hinged motion to the same joint although one may be connected to the joint through the other. Accordingly, the upwardly extending handles 106 move in unison with the pedals 108. In a related embodiment the handles 106 and the pedals 108 may each directly connect to a hinged joint in a fixed relation to each other. Thus, the handles 106 and pedals 108 may still move in unison.

Figure 2:
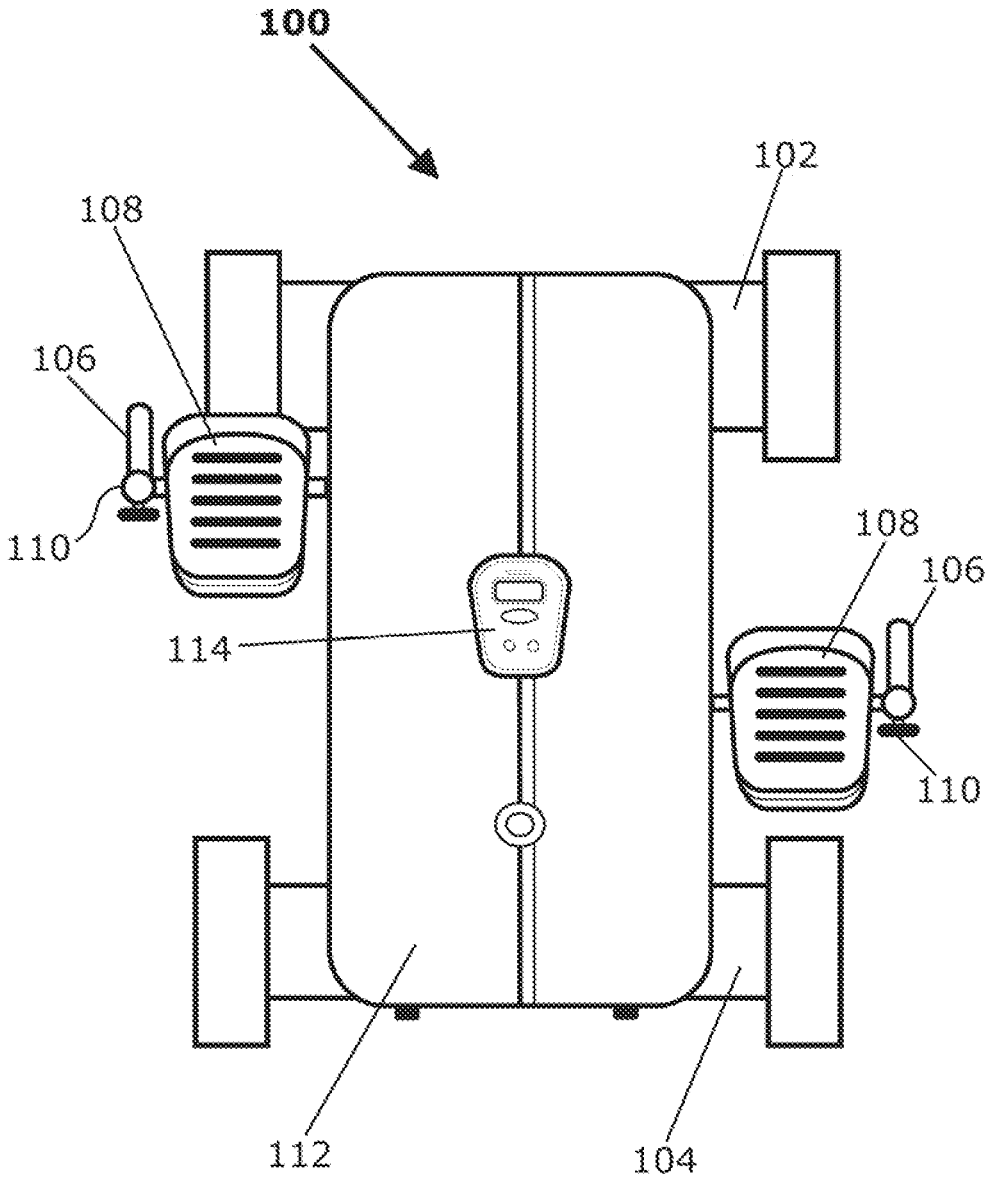
FIG. 2 is a top view of an embodiment.
Figure 3:
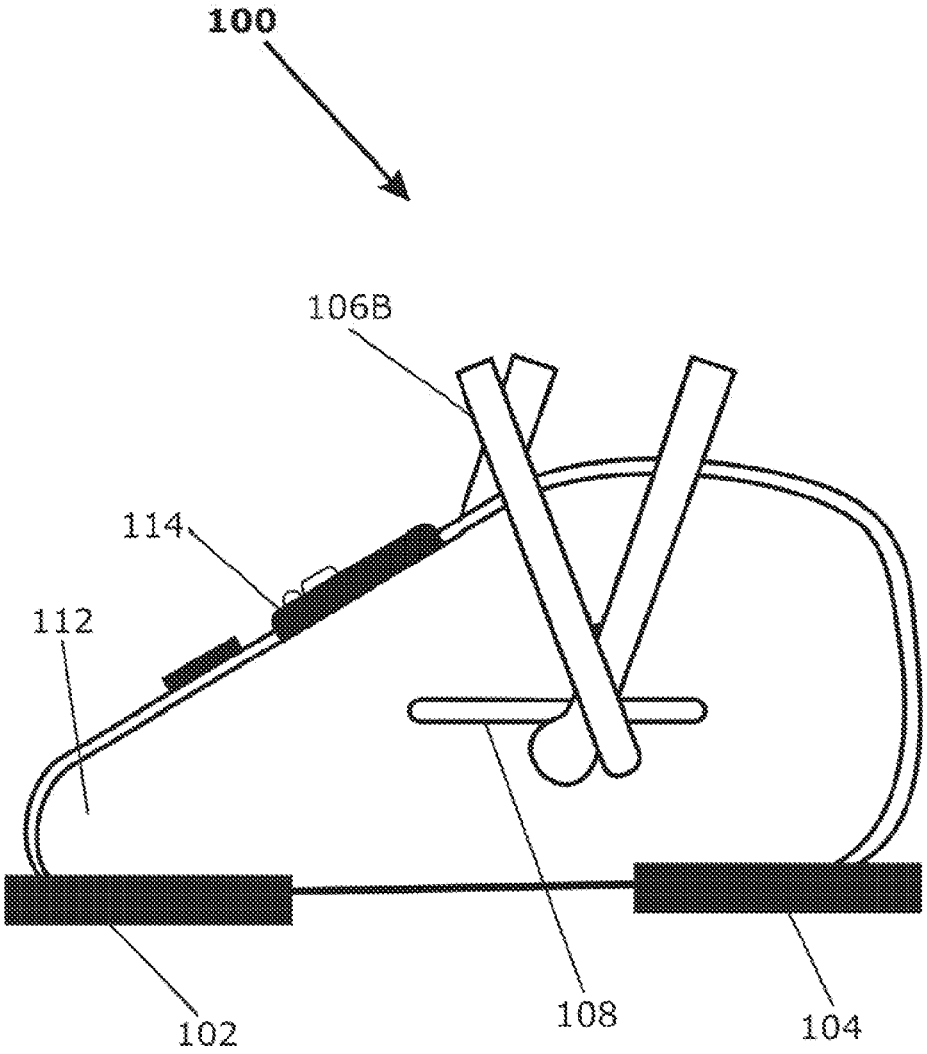
FIG. 3 is a side view of an embodiment.

As shown in FIGS. 1, 2 and 3 embodiments may include a pair of front legs 102 which may provide vertical as well as lateral support to a fore end of the device. Similarly, a rear base 104 may be included to provide vertical and lateral support to the aft portion of the device. The front legs 102 and/or the rear base 104 may be foldable; however, in some embodiments their configuration may be fixed. In embodiments having fixed front legs 102 and/or rear bases 104 the leg 102 and base 104 elements may be sized and configured to be sufficiently compact to render the device portable without folding. Additionally, embodiments may include a display unit 114 for indicating, e.g. the duration and/or intensity of exercise, or other parameters which may be useful or convenient to a user.

Figure 4:
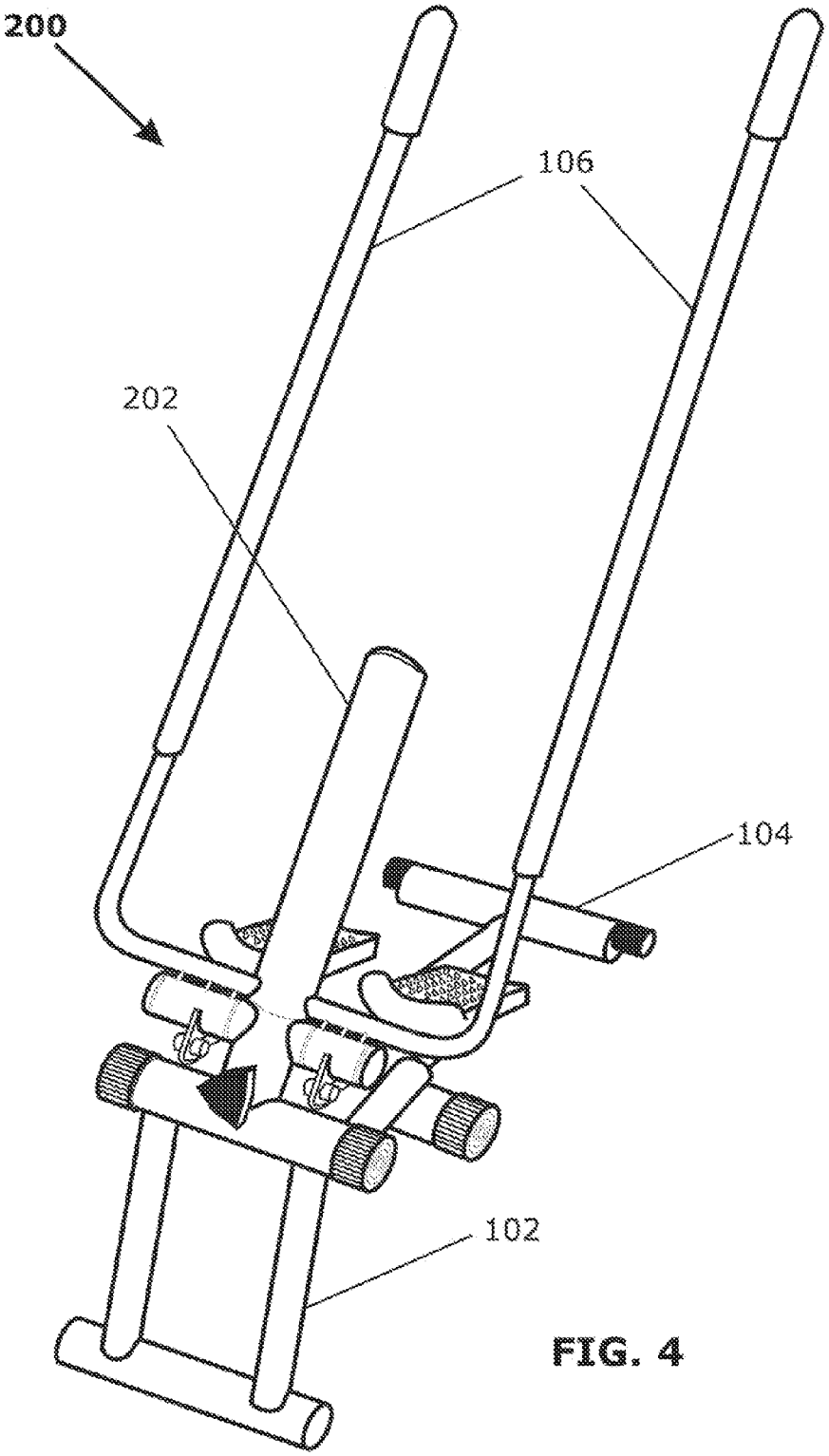
FIG. 4 is a front elevation view of an embodiment without a chassis.
Figure 5:
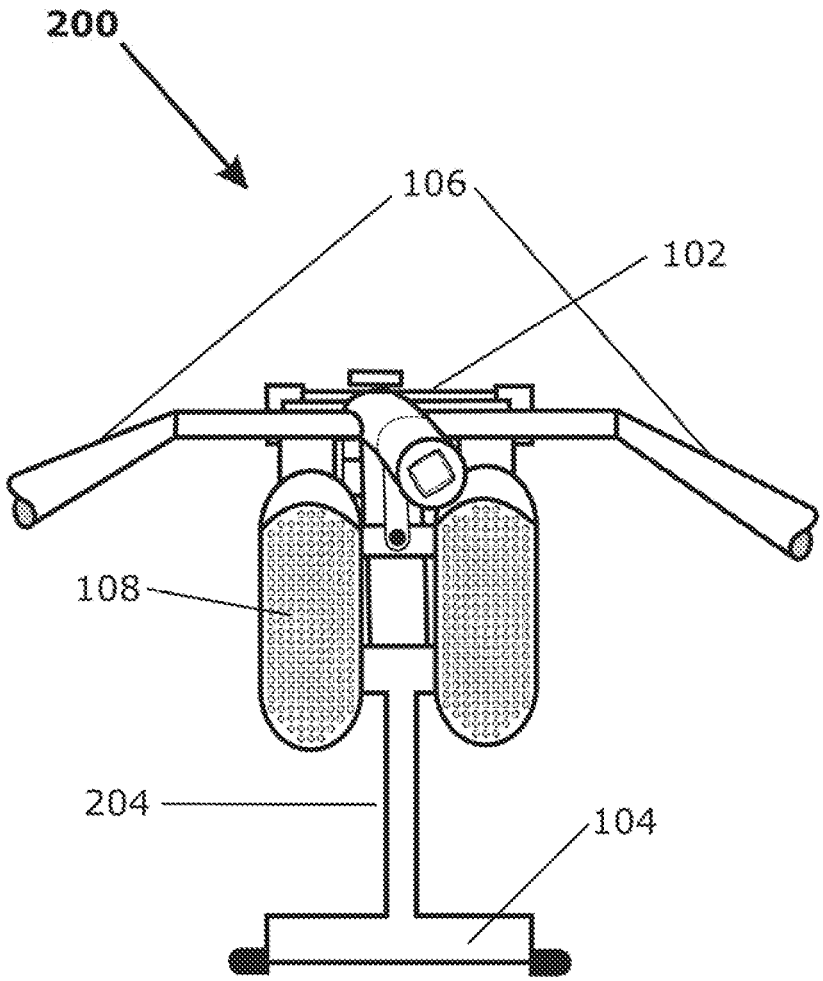
FIG. 5 is a top view of an embodiment without a chassis.
Figure 6:
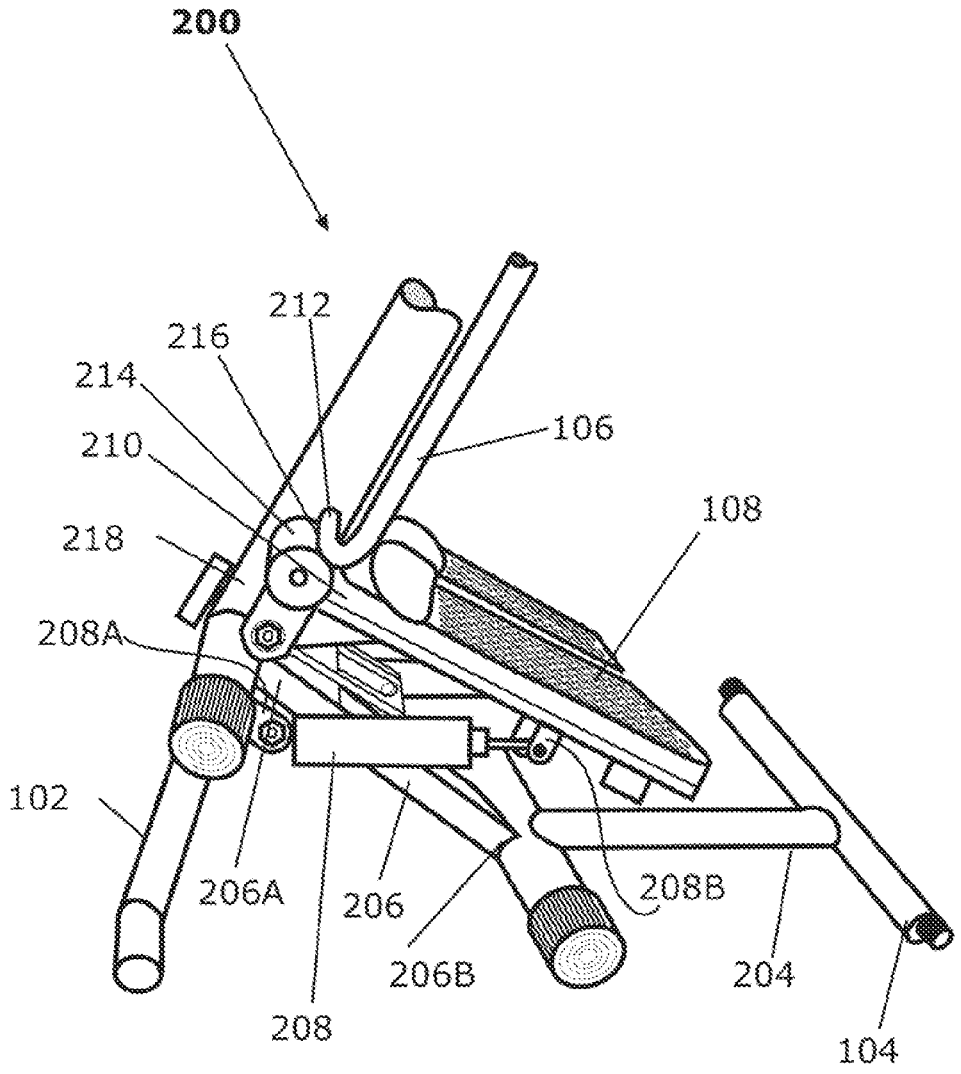
FIG. 6 is a side view of an embodiment without a chassis.

FIGS. 4 through 7 illustrate a second embodiment 200 lacking a chassis, or where the chassis has been removed for viewing the internal components. FIG. 4 illustrates and embodiment 200 having a pair of rearwardly swept handles 106, a rear base 104 and a pair of front legs 102. The embodiment 202 also includes a display mounted at the top of a central post 202. FIG. 5 is a top view wherein the pedals 108 and the display are more clearly visible. Turning to FIG. 6, the embodiment 200 is shown in side view in more detail. From this perspective T-shaped beam 204 is shown as part of the rear base 104 which is joined to an aft end 206B of the main body 206. Also visible is one of the front legs 102 which is joined to the main body 206 at its fore end 206A. A resistance element 208 is shown being hingedly joined at a fore end 208A to the frame and at its aft end 208B to the underside of a pedal 108.

From the side view perspective of FIG. 6 the relationship of the handles, pedals, and frame also become clearer according to this embodiment 200. The pedals 108 are mounted on a pedal base 210 which is welded to a hub 214. The upwardly extending handle 106 is shown forming an L-shaped portion 212 at its base which is welded 216 to the hub 214 at about ninety degrees relative to the pedal base 210; however, the precise angle is not critical. The entire assembly of the handle 106 and pedal base 210 is hingedly joined through the hub 214 to an upward frame element 218. The extension of the upward frame element 218 is regarded herein as upward although it is necessarily directly vertical in a deployed configuration relative to the floor.

Figure 7:
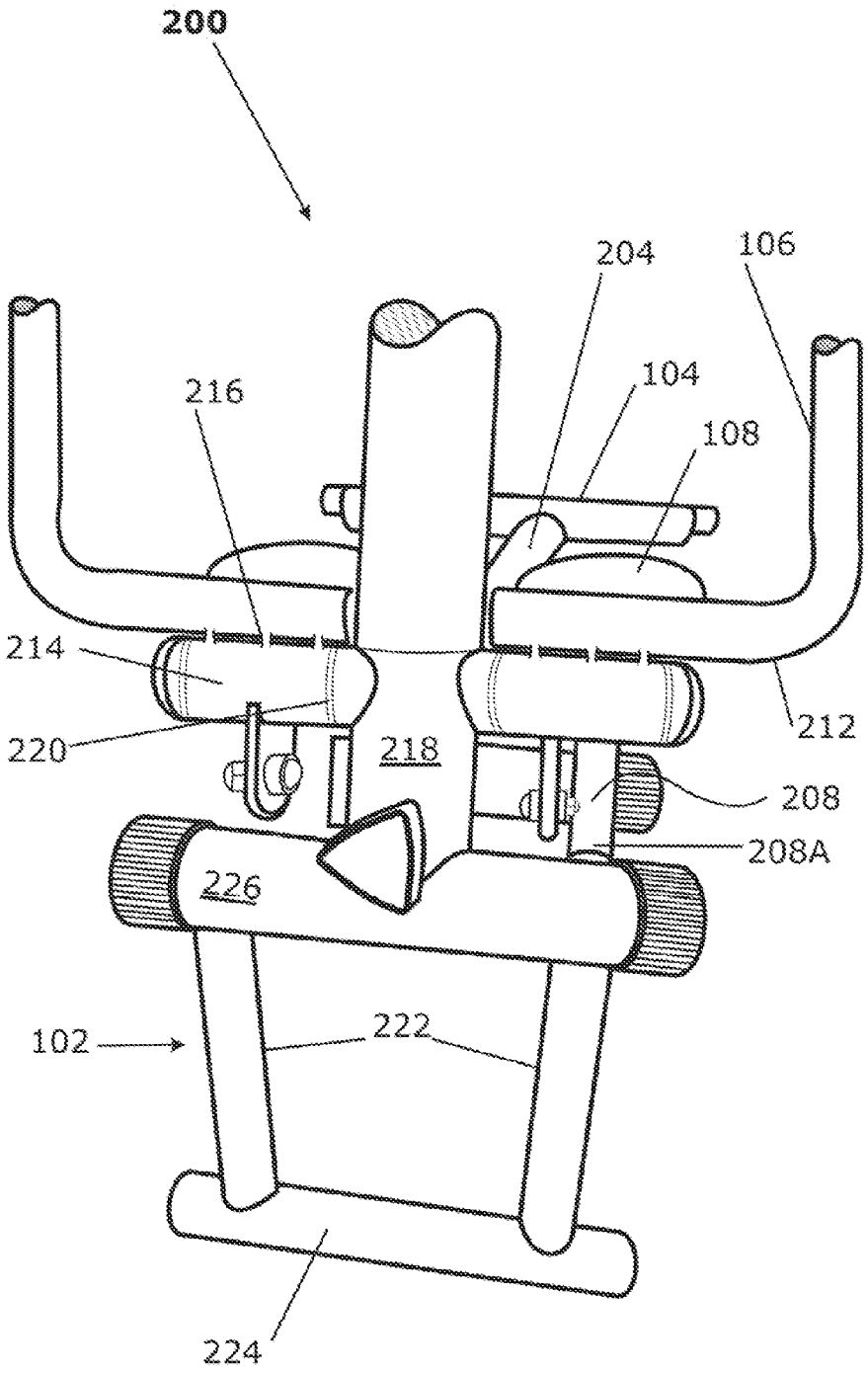
FIG. 7 is a front close-up view of an embodiment without a chassis.

Turning to the front view shown in FIG. 7, the hinge joint 220 between the hub 214 and the upward frame element 218 is visible. Also shown is that the front legs 102 of this embodiment 200 have several components. A top cross member 226 joins to the base of the upward frame element 218 through a weld joint, and a pair of legs 222 extend downward therefrom and attach to a bottom cross member 224 through another weld joint.

Figure 8A:
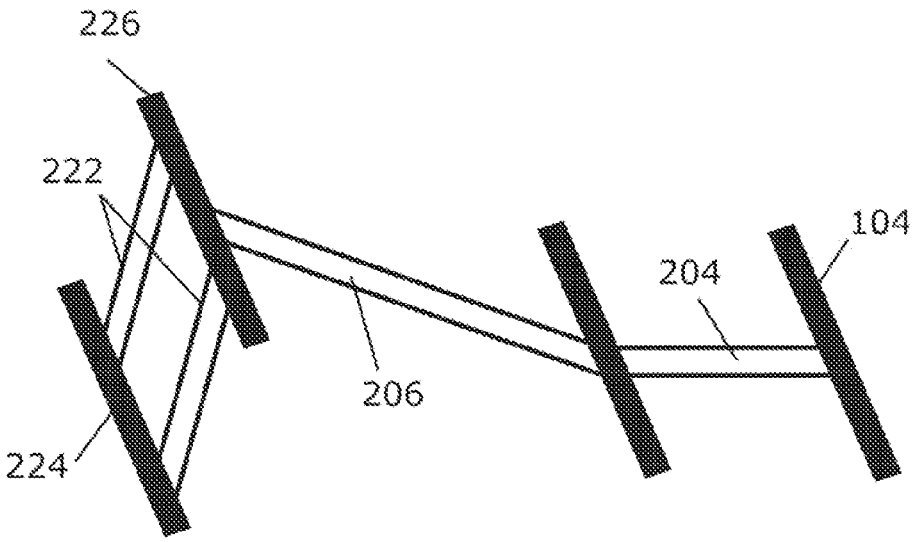
FIG. 8A is a view of a deployed configuration.
Figure 8B:
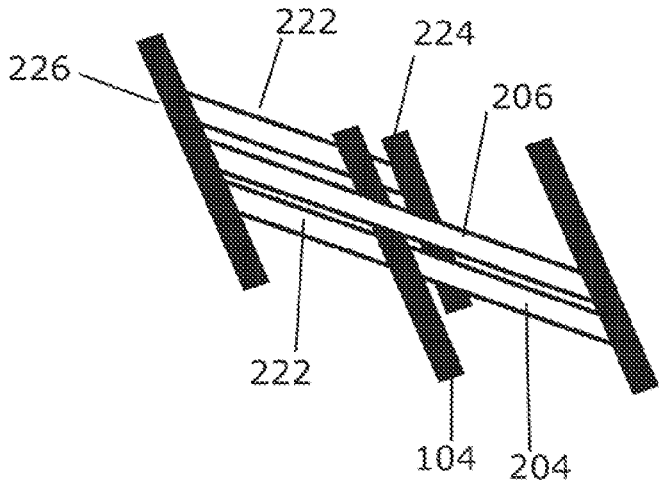
FIG. 8B is a view of a folded or collapsed configuration.

Finally, FIGS. 8A and 8B illustrate how an embodiment may fold or collapse to make it more portable. FIG. 8A shows a deployed configuration focusing on the position of key frame elements and support members. FIG. 8B illustrates a collapsed or folded configuration, again focusing on the same key frame elements and support members.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

Having thus described the invention, it is now claimed:

I claim:

1. A portable recumbent stepper device, comprising:

a frame having a main body defined by at least one fore-to-aft beam, a front leg joined to a fore end of the main body and adapted to provide vertical support and lateral stabilization to the main body, and a rear support comprising an aft end of the main body and adapted to provide vertical support and lateral stabilization to the main body, wherein the rear support further comprises a rearwardly extendable base hingedly joined to the aft end of the main body;

an upward frame element fixedly joined to the fore end of the main body and adapted to extend upwardly when the device is in a deployed configuration;

a pair of foot pedals hingedly joined to the upward frame element;

a pair of upwardly extending handles hingedly joined to the upward frame element at a substantially right angle relative to the foot pedals and through common joints with the foot pedals, wherein each of the pair of upwardly extending handles hingedly moves in unison with a corresponding foot pedal, and wherein the motion of either the foot pedal or the corresponding upwardly extending handle results in hinged motion of the other;

a pair of resistance elements each joined to the frame at one end and to one of the pair of foot pedals at another end; and the portable recumbent stepper device lacking a seat for a human user, and instead being adapted to cooperate with an arbitrary seat provided by the user, wherein the seat is disposed rearward of the frame.

2. The device of claim 1, wherein each of the pair of resistance elements is hingedly joined at one end to the frame and at another end to one of the pair of foot pedals.

3. The device of claim 2, wherein each of the pair of resistance elements is independently selected from a hydraulic cylinder, a coil spring, a leaf spring, and a gas spring.

4. The device of claim 1, wherein the rearwardly extendable base further comprises a T-shaped beam, wherein the T-shaped beam is adapted to lay flat on a floor when the device is in a deployed configuration, and adapted to be folded inward in a stowed configuration.

5. The device of claim 1, wherein the front leg is hingedly joined to the main body and adapted to be configurable in a deployed or stowed relation to the main beam.

6. The device of claim 1, wherein each of the upwardly extending handles includes an upper shaft and a lower shaft which receives the upper shaft in a telescoping relation being adapted to compact the upwardly extending handles into a stowed configuration.

7. The device of claim 1, wherein each of the upwardly extending handles is configurable in a rearwardly swept configuration adapted to accommodate the seated user.

* * * * *